US008687466B2

(12) United States Patent
Kim

(10) Patent No.: US 8,687,466 B2
(45) Date of Patent: Apr. 1, 2014

(54) CELL, ELEMENT OF ULTRASONIC TRANSDUCER, ULTRASONIC TRANSDUCER INCLUDING THE SAME, AND METHOD OF MANUFACTURING CELL OF ULTRASONIC TRANSDUCER

(75) Inventor: Dong-kyun Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/555,855

(22) Filed: Jul. 23, 2012

(65) Prior Publication Data

US 2013/0155817 A1 Jun. 20, 2013

(30) Foreign Application Priority Data

Dec. 19, 2011 (KR) ..... 10-2011-0137412

(51) Int. Cl.
*B06B 1/06* (2006.01)

(52) U.S. Cl.
CPC ..... *B06B 1/06* (2013.01)
USPC ..... 367/189; 367/173

(58) Field of Classification Search
USPC ..... 367/189
See application file for complete search history.

(56) References Cited

U.S. PATENT DOCUMENTS

| | | | | |
|---|---|---|---|---|
| 6,836,020 | B2 * | 12/2004 | Cheng et al. | 257/774 |
| 7,612,635 | B2 * | 11/2009 | Huang | 333/186 |
| 7,846,102 | B2 | 12/2010 | Kupnik et al. | |
| 2004/0085858 | A1 * | 5/2004 | Khuri-Yakub et al. | 367/181 |
| 2007/0013269 | A1 * | 1/2007 | Huang | 310/334 |
| 2007/0164631 | A1 * | 7/2007 | Adachi et al. | 310/311 |
| 2007/0228878 | A1 * | 10/2007 | Huang | 310/322 |
| 2008/0048211 | A1 | 2/2008 | Khuri-Yakub et al. | |
| 2008/0197751 | A1 * | 8/2008 | Huang | 310/311 |
| 2008/0242984 | A1 * | 10/2008 | Oakley et al. | 600/442 |
| 2009/0122651 | A1 * | 5/2009 | Kupnik et al. | 367/181 |
| 2009/0140357 | A1 * | 6/2009 | Kupnik et al. | 257/416 |
| 2010/0013574 | A1 | 1/2010 | Huang | |
| 2010/0254222 | A1 * | 10/2010 | Huang | 367/181 |
| 2010/0256501 | A1 * | 10/2010 | Degertekin | 600/463 |
| 2011/0154649 | A1 * | 6/2011 | Masaki | 29/594 |
| 2011/0169510 | A1 * | 7/2011 | Kandori et al. | 324/686 |

FOREIGN PATENT DOCUMENTS

JP 201125055 A 2/2011

* cited by examiner

*Primary Examiner* — Isam Alsomiri
*Assistant Examiner* — James Hulka
(74) *Attorney, Agent, or Firm* — Sughrue Mion, PLLC

(57) ABSTRACT

An element of an ultrasonic transducer includes a first substrate, at least one cell of the ultrasonic transducer arranged above the first substrate, and a second substrate arranged under the first substrate, in which a first power supply for applying an electric signal to the first substrate is formed.

17 Claims, 9 Drawing Sheets

CELL, ELEMENT OF ULTRASONIC TRANSDUCER, ULTRASONIC TRANSDUCER INCLUDING THE SAME, AND METHOD OF MANUFACTURING CELL OF ULTRASONIC TRANSDUCER

CROSS-REFERENCE TO RELATED APPLICATIONS

This application claims priority from Korean Patent Application No. 10-2011-0137412, filed on Dec. 19, 2011, in the Korean Intellectual Property Office, the disclosure of which is incorporated herein in its entirety by reference.

BACKGROUND

1. Field

Methods and apparatuses consistent with the exemplary embodiments relate to a cell of an ultrasonic transducer, an element of an ultrasonic transducer including the cell, an ultrasonic transducer including the element, a method of manufacturing the cell, and a method of manufacturing the ultrasonic transducer.

2. Description of the Related Art

A micromachined ultrasonic transducer (MUT) may convert an electric signal to an ultrasonic signal or vise versa. An MUT is used for, for example, medical image diagnosis apparatuses, and is advantageous in obtaining a picture or image of a tissue or an organ of a human body in a non-invasive manner. The MUT may include a piezoelectric micromachined ultrasonic transducer (pMUT), a capacitive micromachined ultrasonic transducer (cMUT), and a magnetic micromachined ultrasonic transducer (mMUT).

SUMMARY

Provided are a cell of an ultrasonic transducer, an element of an ultrasonic transducer including the cell, an ultrasonic transducer including the element, a method of manufacturing the cell, and a method of manufacturing the ultrasonic transducer.

Additional aspects will be set forth in part in the description which follows and, in part, will be apparent from the description, or may be learned by practice of the presented exemplary embodiments.

According to an aspect of the exemplary embodiments, an element of an ultrasonic transducer includes a first substrate, at least one cell of the ultrasonic transducer arranged above the first substrate, and a second substrate arranged under the first substrate, in which a first power supply for applying an electric signal to the first substrate is formed.

The first substrate may be formed of a low-resistance material.

The cell of the ultrasonic transducer may include a vibrator which vibrates, and is separated from the first substrate, a supporter supporting the vibrator, and a connector connecting the vibrator and the supporter.

The first power supply may include a conductive via provided in the second substrate, a first electrode pad arranged above the conductive via, and a second electrode pad arranged under the conductive via.

The first substrate may operate as an electrode and may further include an electrode layer that is formed on the cell of the ultrasonic transducer.

The connector may include a first sub-connector having one end connected to the vibrator, a second sub-connector having one end connected to the supporter, and a third sub-connector having one end connected to the first sub-connector and the other end connected to the second sub-connector and being deformable.

The vibrator may vibrate in a direction perpendicular to the first substrate due to deformation of the third sub-connector.

The third sub-connector may be formed of a material that is different from the first and second sub-connectors.

The first and second sub-connectors may be formed of an oxide and the third sub-connector may be formed of silicon.

The supporter may include a first sub-supporter arranged on the first insulation layer, a second sub-supporter arranged on the first sub-connector and parallel to the vibrator, and a third sub-supporter arranged on the second sub-supporter.

The second sub-supporter may be formed of the same material as the vibrator.

The vibrator may be formed of silicon.

The element may further include a second insulation layer arranged under the first substrate and having an opening formed in an area corresponding to the first power supply.

The element may further include a first electrode contact formed in an area including the opening and electrically connected to the first power supply.

According to another aspect of the exemplary embodiments, an ultrasonic transducer including a plurality of elements of the ultrasonic transducer according to any one of the above elements.

The first substrate included in each of the neighboring elements of the ultrasonic transducer may be arranged to be separated from each other.

The ultrasonic transducer may further include a second power supply for applying a common electric signal to the plurality of elements of the ultrasonic transducer.

According to another aspect of the exemplary embodiments, a method of manufacturing an ultrasonic transducer includes forming an oxide layer on a first silicon-on-insulator (SOI) wafer, forming a partial portion of a cell of the ultrasonic transducer by patterning the oxide layer and an element wafer of the first SOI wafer, bonding a second SOI wafer to the partial portion of the cell of the ultrasonic transducer, removing a handle wafer and an insulation layer of the second SOI wafer, forming a second oxide layer on an element wafer of the second SOI wafer, and forming another portion of the cell of the ultrasonic transducer by patterning the second oxide layer and the element wafer of the second SOI wafer.

The cell of the ultrasonic transducer may include a vibrator which vibrates, a supporter which is separated from the vibrator and supports the vibrator, and a connector connecting the vibrator and the supporter.

The partial areas of the connector and the supporter may be formed by the first oxide layer and the element wafer of the first SOI wafer, and another area of the vibrator and the supporter may be formed by the second oxide layer and the element wafer of the second SOI wafer.

The method may further include preparing a first substrate above which a first insulation layer is formed, bonding the first insulation layer to the cell of the ultrasonic transducer, exposing the first insulation layer by etching a partial area of the first substrate, and forming a first power supply provided under the first substrate and supplying power to the first substrate.

The method may further include forming a first electrode contact on the exposed first insulation layer, wherein the power supply is formed to contact the first electrode contact.

The cell of the ultrasonic transducer may be provided in a multiple number, and the method may further include forming a plurality of elements of the ultrasonic transducer by forming a first hole penetrating the first substrate.

The method may further include forming an electrode layer on the cell of the ultrasonic transducer, forming a second hole penetrating the first substrate, and forming a second electrode contact connected to the electrode layer via the second hole.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION OF THE EXEMPLARY EMBODIMENTS

Figure 1A:
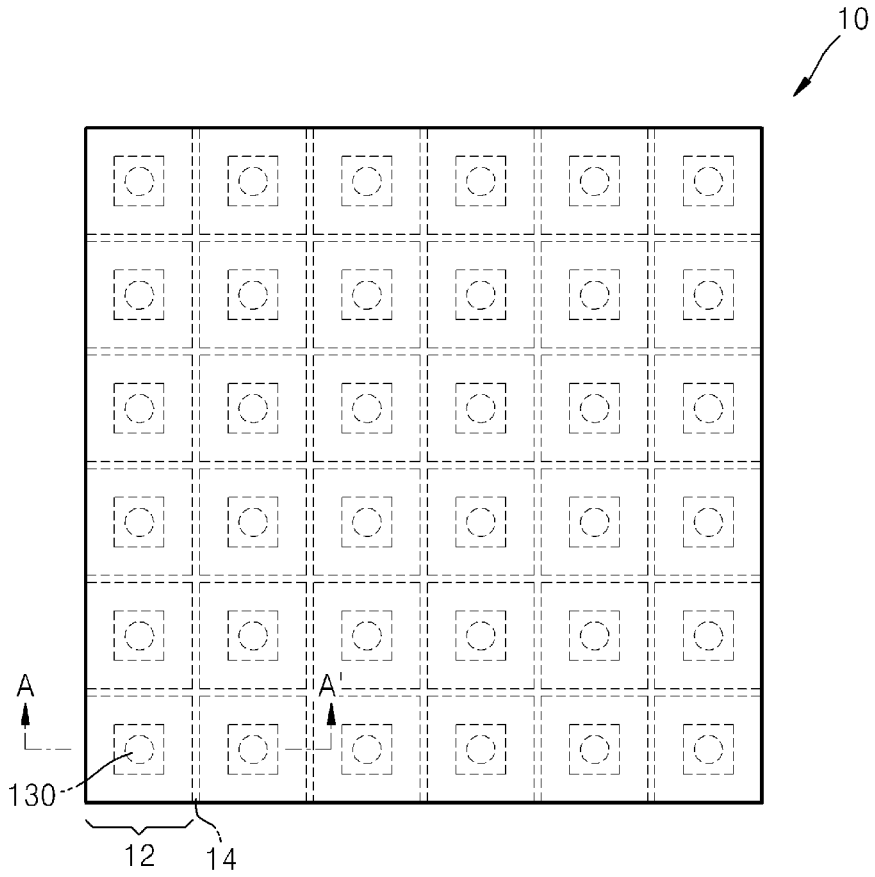
FIG. 1A is a plan view schematically illustrating an ultrasonic transducer according to an exemplary embodiment.

Reference will now be made in detail to exemplary embodiments, examples of which are illustrated in the accompanying drawings, wherein like reference numerals refer to the like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Figure 1B:
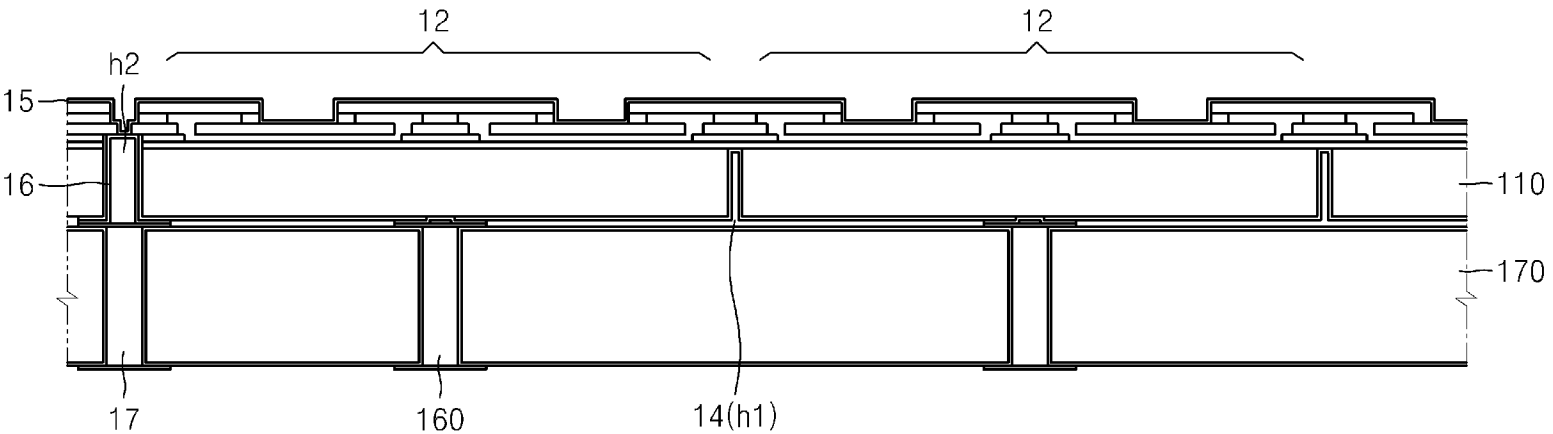
FIG. 1B is a cross-sectional view taken along line A-A' of the ultrasonic transducer of FIG. 1A.
Figure 2:
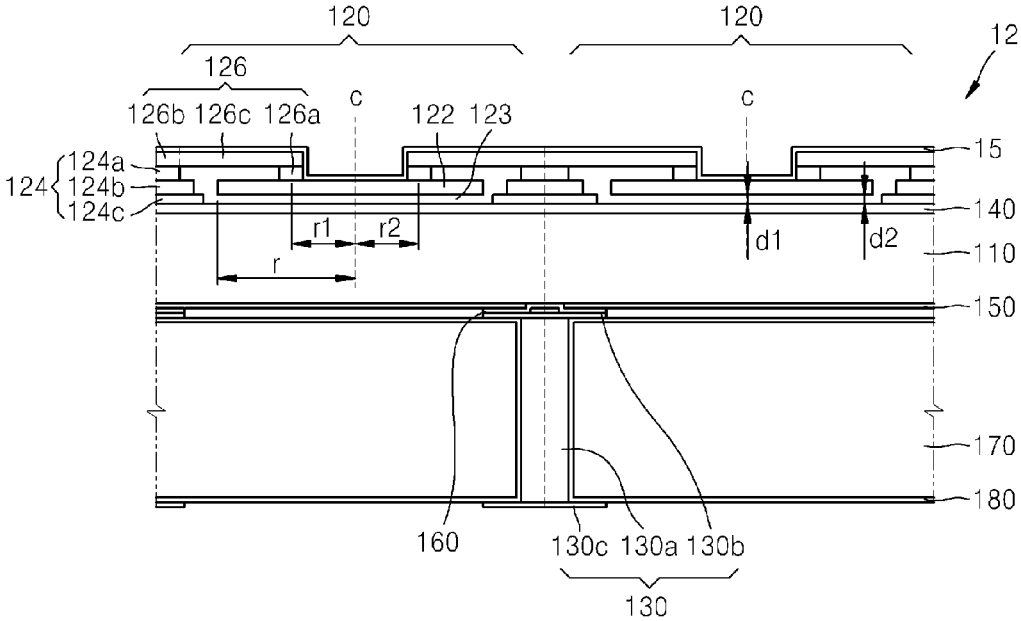
FIG. 2 is a cross-sectional view schematically illustrating an element of an ultrasonic transducer according to an exemplary embodiment.

FIG. 1A is a plan view schematically illustrating an ultrasonic transducer 10 according to an exemplary embodiment. FIG. 1B is a cross-sectional view taken along line A-A' of the ultrasonic transducer 10 of FIG. 1A. FIG. 2 is a cross-sectional view schematically illustrating an element of the ultrasonic transducer 10 according to an exemplary embodiment.

Referring to FIGS. 1A and 1B, the ultrasonic transducer 10 according to the present exemplary embodiment may include a plurality of elements 12 of the ultrasonic transducer 10 (hereinafter, referred to as the elements 12) and at least one electric connection preventer 14 for preventing electric connection between the elements 12.

The elements 12 of the ultrasonic transducer 10 may be provided in an array of m×n, where "m" and "n" are natural numbers equal to or greater than 1. In FIG. 1A, the elements 12 are provided in an array of 6×6, but the exemplary embodiments are not limited thereto. The electric connection preventer 14 is provided among the elements 12 and prevents electric connection between the elements 12 so as to individually drive each of the elements 12. The electric connection preventer 14 is formed as a first hole h1 that penetrates a first substrate 110 included in the elements 12 so as not to be electrically connected to the first substrate 110 of the neighboring element 12. Also, a bulk acoustic wave that may be propagated to the neighboring element 12 is blocked by the electric connection preventer 14 so that interference between the elements 12 may be reduced.

The ultrasonic transducer 10 may further include an electrode layer 15 commonly formed in the elements 12, a first electrode contact 16 electrically connected to the electrode layer 15, and a first power supply 17 for applying an electric signal, for example, a voltage, to the electrode layer 15 through the first electrode contact 16. The first electrode contact 16 may be arranged on an inner area of a second hole h2 formed in the first substrate 110 and in an area around the second hole h2. At least a part of an upper portion of the first electrode contact 16 is connected to the electrode layer 15. The first power supply 17 is arranged under the first electrode contact 16 and may be connected to at least a part of a lower portion of the first electrode contact 16. The first power supply 17 may include a first conductive via 17*a* (see FIG. 3L) provided in a second substrate 170, a first electrode pad 17*b* (see FIG. 3L) arranged above the first conductive via 17*a* and electrically connecting the first electrode contact 16 and the first conductive via 17*a*, and a second electrode pad 17*c* (see FIG. 3L) arranged under the first conductive via 17*a* and electrically connecting an external signal source and the first conductive via 17*a*.

Although one electrode layer 15, one first electrode contact 16, and one first power supply 17 are provided in the ultrasonic transducer 10 according to the above-described present exemplary embodiment, the exemplary embodiments are not limited thereto. The electrode layer 15, the first electrode contact 16, and the first power supply 17 may be provided for each of the elements 12 or one for at least two elements 12. However, when one electrode layer 15, one first electrode contact 16, and one first power supply 17 are provided in the ultrasonic transducer 10, the structure and operation of the ultrasonic transducer 10 are simplified.

The elements 12 are described in detail with reference to FIG. 2. Referring to FIG. 2, each of the elements 12 includes the first substrate 110, at least one cell 120 of the ultrasonic transducer 10 (hereinafter, referred to as the cell 120) arranged above the first substrate 110, and a second power supply 130 for commonly applying an electric signal, for example, a voltage, to the cell 120. The elements 12 may further include a first insulation layer 140 arranged above the first substrate 110 and preventing electric connection between the first substrate 110 and the cell 120, a second insulation layer 150 including an opening and arranged under the first substrate 110, a second electrode contact 160 arranged in an area including an opening of the second insulation layer 150 and electrically connected to the first substrate 110, the second substrate 170 supporting the second power supply 130, and a third insulation layer 180 surrounding a surface of the second substrate 170. The cell 120 of the elements 12 may be provided in an array of p×q where "p" and "q" are natural numbers equal to or greater than 1. FIG. 2 illustrates the two cells 120 as an example.

The first substrate 110 may be a low-resistance substrate and may be used as an electrode. A separate structure for supplying power is not needed because the first substrate 110 is used as an electrode. Thus, since the plurality of cells 120 are provided in an entire area of the elements 12, an effective area may be increased and a high frequency range signal may be transmitted/received.

Each of the cells 120 may include a vibrator 123 which vibrates, and is separated from the first substrate 110, a supporter 124 arranged on the first insulation layer 140 and supporting the vibrator 122, and a connector 126 connecting the supporter 124 and the vibrator 122.

The vibrator may be provided to be separated from the first substrate 110. The vibrator 122 may be formed of, for example, monocrystal silicon. The vibrator 122 may be circular or polygonal, but not limited thereto. The supporter 124 may be arranged on the first insulation layer 140 to be separated from the vibrator 122. The supporter 124 may be formed in a multilayer structure including at least one oxide layer and at least one silicon layer. For example, the supporter 124 may be formed of two oxide layers separately arranged and a silicon layer arranged between the two oxide layers.

The connector 126 may connect the supporter 124 and the vibrator 122 and may be formed of, for example, at least one of silicon and oxide. The connector 126 may include a first sub-connector 126*a* having one end connected to the vibrator 122, a second sub-connector 126*b* having one end connected to the supporter 124, and a third sub-connector 126*c* having one end connected to the first sub-connector 126*a* and the other end connected to the second sub-connector 126*b*.

The first sub-connector 126*a* may be connected to an upper portion of the vibrator 122 and may extend in a direction perpendicular to the vibrator 122. The first sub-connector 126*a* may be symmetrically provided with respect to a center C of the vibrator 122. That is, distances r1 and r2 from the first sub-connectors 126*a* located at the opposite edge sides of the vibrator 122 to the center C of the vibrator 122 may be the same. The distances r1 and r2 from the first sub-connectors 126*a* to the center C of the vibrator 122 may be equal to or less than a radius r of the vibrator 126*a*. For example, the distances r1 and r2 from the first sub-connectors 126*a* to the center C of the vibrator 122 may be ½ of the radius r of the vibrator 122 (r1=r2=0.5r). The second sub-connector 126*b* may be connected to an upper portion of the supporter 124 and may extend in a direction parallel to the supporter 124. The second sub-connector 126*b* may be formed to be large above the supporter 124.

The third sub-connector 126*c* may be provided between the first and second sub-connectors 126*a* and 126*b* and may be elastically deformed. The third sub-connector 126*c* may be elastically deformed due to a thin thickness thereof. The third sub-connector 126*c* may be provided to be parallel to the first substrate 110 and/or the vibrator 122.

The vibrator 122 may be vibrated in a direction perpendicular to the first substrate 110 due to elastic deformation of the third sub-connector 126*c*. That is, the vibrator 122 may move up and down with respect to the first substrate 110 like a piston. The vibrator 122 may form a cavity 123 with the first substrate 110, the supporter 124, and the connector 126. The cavity 123 may be in a vacuum state.

The electrode layer 15 may be arranged on the vibrator 122 and the connector 126 of all cells 120 of the elements 12. The electrode layer 15 may be formed of a conductive material, for example, copper (Cu), aluminum (Al), gold (Au), chromium (Cr), molybdenum (Mo), titanium (Ti), platinum (Pt), etc. The electrode layer 15 may be extended to the first electrode contact 16. The electrode layer 15 may receive a voltage from an external ground or a DC bias signal source through the first electrode contact 16. Accordingly, the first sub-connector 126*a* of the connector 126 may be formed of an oxide and, because there is no direct electric connection, a ground signal or a DC bias signal is applied to the electrode layer 15 so that electric charges may not be accumulated in the connector 126. Thus, the ultrasonic transducer 10 may be stably operated without a change in characteristic according to the passage of time.

The first insulation layer 140 may be arranged on the first substrate 110 to prevent electric connection between the first substrate 110 and the cell 120. The second insulation layer 150 may be arranged under the first substrate 110 and a lateral surface of the first substrate 110 including inner walls of the first and second holes h1 and h2. The second insulation layer 150 may prevent not only electric connection between the elements 12 but also electric connection between the first substrate 110 and the first electric contact 16. Also, the second insulation layer 150 may include an opening for exposing the first substrate 110 from a lower portion of the first substrate 110. The second electrode contact 160 is arranged in an area including the opening so as to connect the first substrate 110 and the second power supply 130.

Also, the second power supply 130 may not only apply an electric signal, for example, a voltage, from the external signal source to the first substrate 110, but also transmit a change in the electric signal, for example, a change in capacitance, between the first substrate 110 and the vibrator 122 to the outside. The second power supply 130 may include a second conductive via 130*a* provided in the second substrate 170, a third electrode pad 130*b* arranged above the conductive via 130*a* and electrically connecting the second conductive via 130*a* and the second electrode contact 160, and a fourth electrode pad 130*c* arranged under the second conductive via 130*a* and electrically connecting the external signal source and the second conductive via 130*a*.

The second substrate 170 supports the first and second power supplies 17 and 130. A plurality of through holes are formed in the second substrate 170 and the first and second power supplies 17 and 130 are arranged in an area including the through holes. The second substrate 170 may be formed of a commonly used material, for example, silicon (Is), glass, etc. The second substrate 170 not only supports the first and second power supplies 17 and 130, but also reinforces strength of the first substrate 110 that has been weakened due to the formation of the holes h1 and h2. The third insulation layer 180 may cover a surface of the second substrate 170. The third insulation layer 180 may prevent an electrical connection between the second substrate 170 and the first and second power supplies 17 and 130. When the second substrate 170 is formed of an insulation material, the third insulation layer 180 may not be formed. The third insulation layer 180 may be arranged on the overall surface of the second substrate 170, or the third insulation layer 180 may be arranged only in a partial area for preventing the electric connection between the second substrate 170 and the first and second power supplies 17 and 130.

The above-described cell 120 may be a cell of a capacitive micromachined ultrasonic transducer (cMUT). That is, the first substrate 110 and the vibrator 122 may form a capacitor. Thus, since the vibrator 122 vibrates uniformly in a direction perpendicular to the first substrate 110, in the elements 12 of the present exemplary embodiment, an average electrostatic force between the first substrate 110 and the vibrator 122 and an amount of change in volume of the cell 120 due to vibration of the vibrator 122 may be increased. As a result, the increase in the average electrostatic force and the volume change amount may improve transmission output and receiving sensitivity of the elements 12 of the ultrasonic transducer 10.

Next, an operation principle of the above-described elements 12 will be described. First, a principle of transmission by the elements 12 will be described below. When a DC voltage (not shown) is applied to the first substrate 110 and the electrode layer 15, the vibrator 122 may be located at a height where the electrostatic force between the first substrate 110 and the vibrator 122 and an elastic restoration force affecting the vibrator 122 are balanced. In a state in which the DC voltage is applied to the first substrate 110 and the electrode layer 15, when an AC voltage is applied to the first substrate 110 and the electrode layer 15, the vibrator 122 may be vibrated by a change in the electrostatic force between the first substrate 110 and the vibrator 122. The vibrator 122 of the elements 12 is not vibrated due to the deformation of the vibrator 122, but is vibrated due to the deformation of the third sub-connector 126*c*. Since the edge side of the vibrator 122 is not directly fixed to the supporter 124, a degree of freedom may be increased. Thus, the vibrator 122 may be moved in a direction perpendicular to the first substrate 110 and parallel to the first substrate 110, not being bent like a bow. That is, the vibrator 122 may be moved up and down like a piston with respect to the first substrate 110 so that a change in the volume of the elements 12 of the ultrasonic transducer 10 may be increased.

In the elements 12 of the ultrasonic transducer 10, when the vibrator 122 is vibrated, a distance d1 between the center of the vibrator 122 and the first insulation layer 140 and a distance d2 between the edge side of the vibrator 122 and the first insulation layer 140 may be the same. Accordingly, the electrostatic force at the centers of the first substrate 110 and the vibrator 122 may be the same as the electrostatic force at the first substrate 110 and the edge side of the vibrator 122. Thus, the average electrostatic force between the first substrate 110 and the vibrator 122 may be increased. As the volume change amount of the elements 12 and the average electrostatic force between the first substrate 110 and the vibrator 122 increase, the transmission output of the elements 12 may be increased.

In the principle of receiving by the elements 12, as in the transmission, when a DC voltage (not shown) is applied to the first substrate 110 and the electrode layer 15, the vibrator 122 may be located at a height where the electrostatic force between the first substrate 110 and the vibrator 122 and the elastic restoration force affecting the vibrator 122 are balanced. In a state in which the DC voltage is applied to the first substrate 110 and the electrode layer 15, when an external physical signal, for example, an ultrasonic wave, is applied to the vibrator 122, the capacitance between the first substrate 110 and the vibrator 122 may be changed. Accordingly, an external ultrasonic wave may be received by sensing a change in capacitance. As in the transmission, the vibrator 122 of the elements 12 of the ultrasonic transducer 10 may be moved in a direction perpendicular to the first substrate 110 and parallel to the first substrate 110. Thus, the change in the volume of the elements 12 of the ultrasonic transducer 10 and the average electrostatic force between the first substrate 110 and the vibrator 122 increase, a receiving sensitivity of the elements 12 of the ultrasonic transducer 10 may be increased.

Next, a method of manufacturing the ultrasonic transducer 10 will be described below. The ultrasonic transducer 10 of the present exemplary embodiment may be manufactured by bonding a plurality of silicon-on-insulator (SOI) wafers in a silicon direct bonding (SDB) method. An SOI wafer is a wafer obtained by sequentially stacking a handle wafer, an insulation layer, and an element wafer. The element wafer may be formed of a silicon material. FIGS. 3A to 3L are cross-sectional views schematically illustrating a manufacturing process of an ultrasonic transducer according to an exemplary embodiment. For convenience of explanation, a method of manufacturing one first power supply 17, one element 12 including two cells 120, and one electric connection preventer 14 of the ultrasonic transducer 10 will be described below.

Figure 3A:
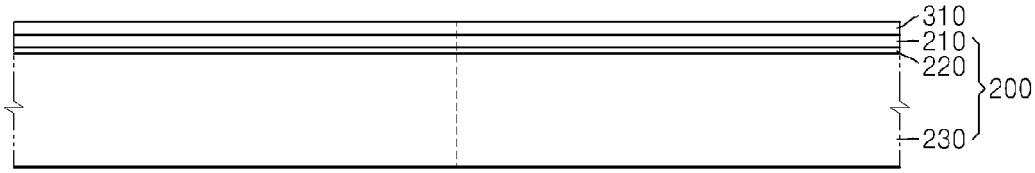
FIGS. 3A to 3L are cross-sectional views schematically illustrating a manufacturing process of an ultrasonic transducer according to an exemplary embodiment.
Figure 3B:
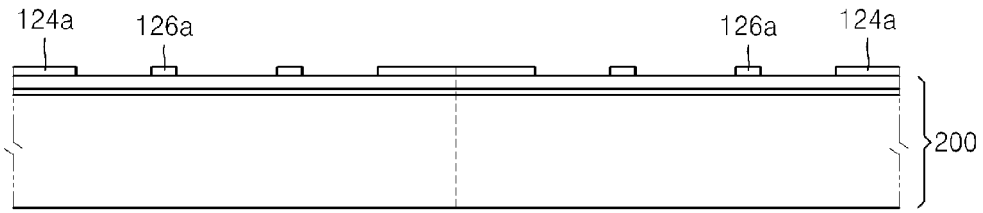

Referring to FIG. 3A, a first oxide layer 310 may be formed on a first SOI wafer 200 in which a first handle wafer 230, an insulation layer 220, and a first element wafer 210 are sequentially stacked. For example, when the first element wafer 210 is formed of a silicon material, the first oxide layer 310 may be a silicon oxide. Referring to FIG. 3B, the first sub-connector 126*a* and the first sub-supporter 124*a* of the connector 126 may be formed by patterning the first oxide layer 310. The first sub-connector 126*a* and the first sub-supporter 124*a* may be concentric when it is viewed from the top.

Figure 3C:
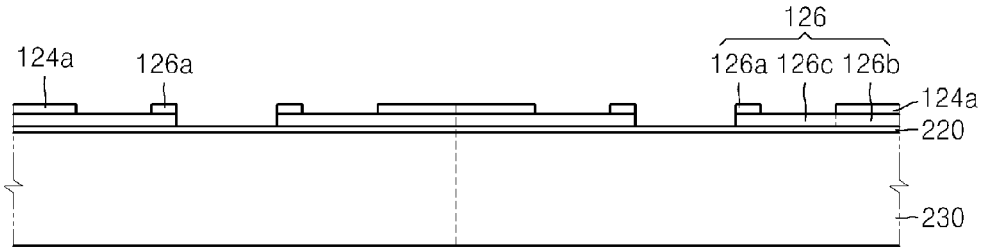
Figure 3D:
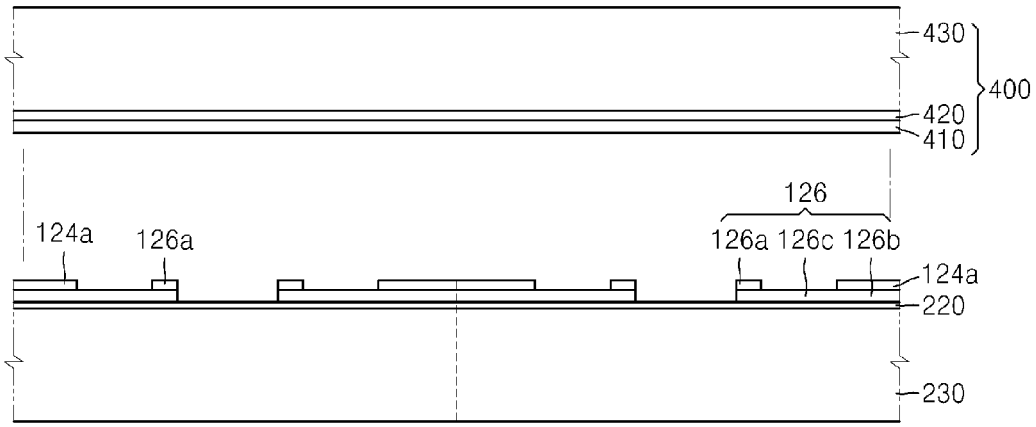
Figure 3E:
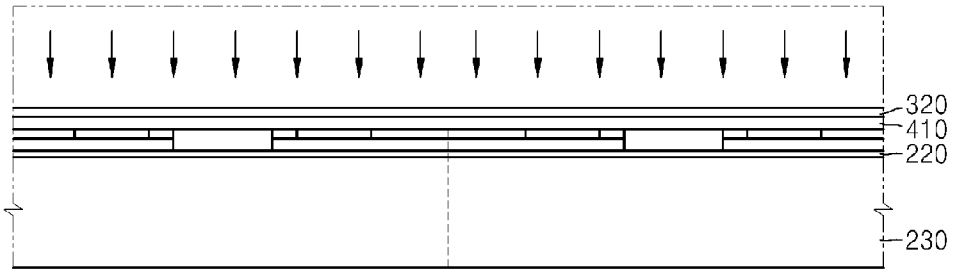

Referring to FIG. 3C, the third sub-connector 126*c* and the second sub-connector 126*b* of the connector 126 may be formed from the first element wafer 210 by etching the first element wafer 210 provided between the neighboring first sub-connectors 126 of the first SOI wafer 200. Referring to FIG. 3D, a second element wafer 410 of a second SOI wafer 400 may be bonded to the first sub-connector 126*a* and the first sub-supporter 124*a* by using an SDB method. Also, since there is no patterned portion in the second SOI wafer 400, the second SOI wafer 400 may be bonded without alignment to the first sub-connector 126*a* and the first sub-supporter 124*a*. Referring to FIG. 3E, the second handle wafer 410 and an insulation layer 420 of the second SOI wafer 400 are removed so that only the second element wafer 420 of the second SOI wafer 400 may be left. A second oxide layer 320 is stacked on the second element wafer 420.

Figure 3F:
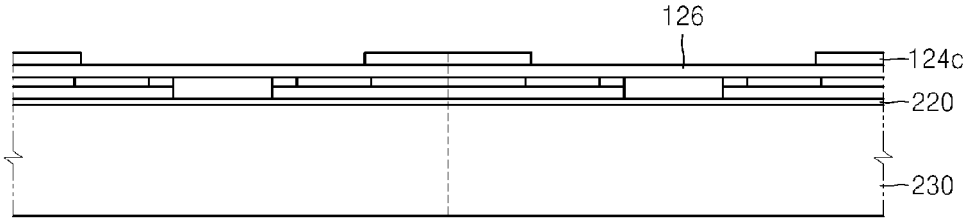
Figure 3G:
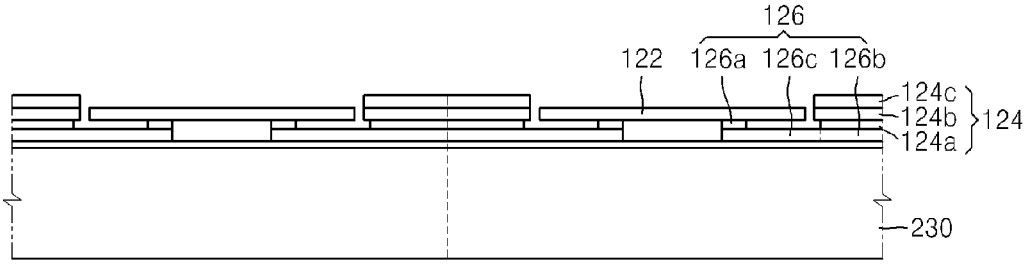

Referring to FIG. 3F, the third sub-supporter 124*c* is formed by patterning the second oxide layer 320. Referring to FIG. 3G, the vibrator 122 and the second supporter 124*b* are formed by patterning the element wafer 420 of the second SOI wafer 400. That is, the vibrator 122 and the second sub-connector 124*b* having no residual stress may be formed by using one second element wafer. At least one cell 120 may be manufactured through the processes of FIGS. 3A to 3G. The cell 120 of FIG. 3G is in an inversed state of being upside down.

Figure 3H:
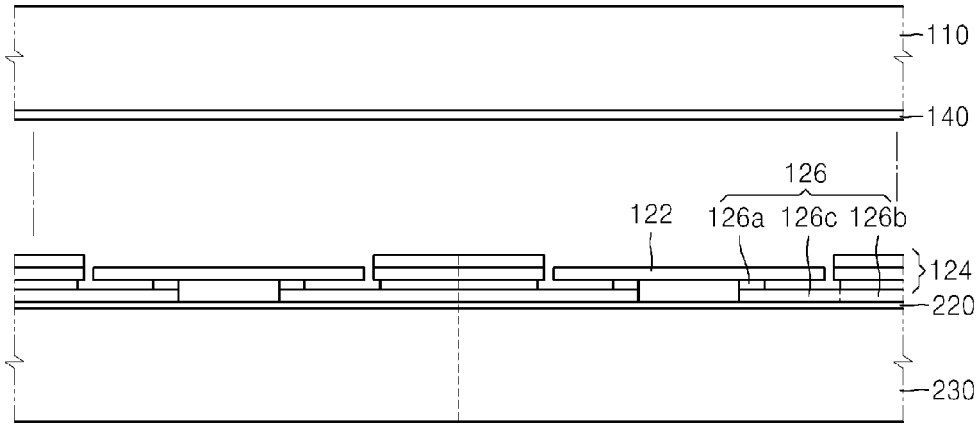
Figure 3I:
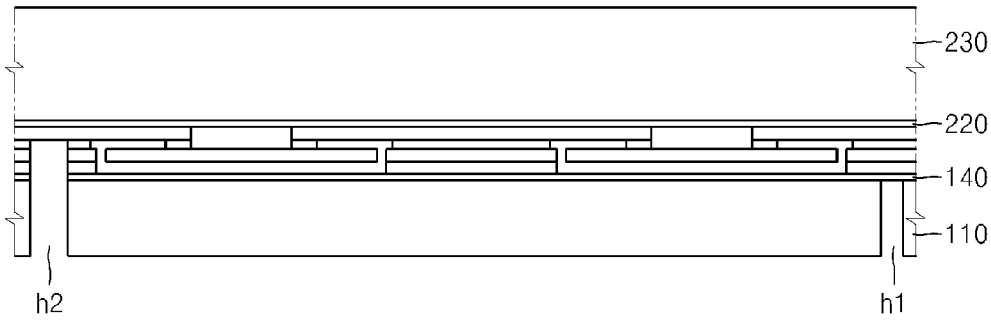

A method of forming the electric connector 14 and the first and second electrode contacts 16 and 160 will be described below. Referring to FIG. 3H, the first substrate 110 under which the first insulation layer 140 is formed may be bonded to a product produced in the process of FIG. 3G in the SDB method. A cavity sealed by the first insulation layer 140, the supporter 124, the connector 126, and the vibrator 122 may be formed. The inside of the cavity may be in a vacuum state. The first substrate 110 may be formed of a low-resistance material. For example, the first substrate 110 may include silicon doped at high concentration, that is, silicon having low resistance, and thus may be used as an electrode. The first insulation layer 140 may be formed by oxidizing a surface of the first substrate 110. The first substrate 110 having a thickness of several hundreds microns may be thinned to have a thickness of several tens of microns. The first substrate 110 may be thinned through a grinding process or a chemical mechanical polishing process. For example, by processing the first substrate 110 having a thickness of about 100 microns to about 500 microns, the first substrate 110 having a thickness of about 10 microns to about 50 microns may be formed.

A product produced in the process of FIG. 3H is turned upside down. Then, referring to FIG. 3I, the cell 120 is arranged on the first substrate 110 where the first insulation layer 140 is formed. The cell 120 includes at least one cell 120. The first hole h1 is formed in the first substrate 110 to section the elements 12. To form the first electrode contact 16, the second hole h2 is formed in the first substrate 110. The first and second holes h1 and h2 may be extended to an area of the supporter 124.

Figure 3J:
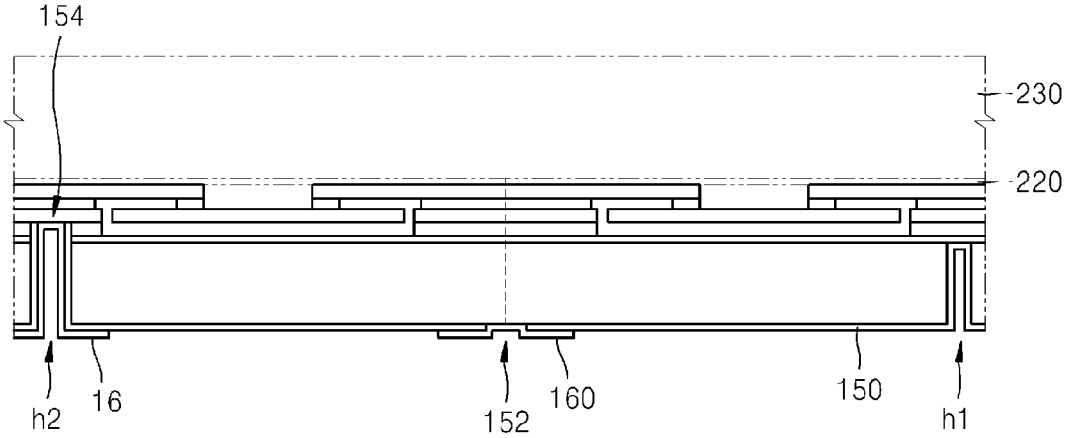

Referring to FIG. 3J, the first opening 152 may be formed to expose a lower portion of the first substrate 110 by etching a part of the first insulation layer 140 arranged under the first substrate 110. The second opening 154 may be formed to expose a part of the supporter 124 by etching a part of the first insulation layer 140 arranged in the second hole h2. The second electrode contact 160 including the first opening 152 and extended to the lower portion of the first substrate 110 is formed. The first electrode contact 16 including the second opening 154 and extended to the lower portion of the first substrate 110 is formed. The first and second electrode contacts 16 and 160 are formed not to be connected to each other. Then, the first handle wafer 230 and the insulation layer 220 of the first SOI wafer 200 are removed.

Figure 3K:
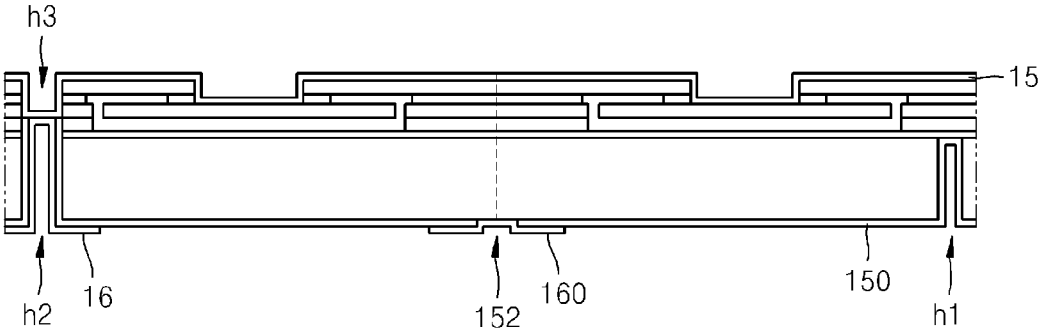

Referring to FIG. 3K, the third hole h3 is formed by etching a part of an area of the connector 126 and the supporter 124 to expose the first electrode contact 16. The electrode layer 15 is formed on the third hole h3, the connector 126, and the vibrator 122.

Figure 3L:
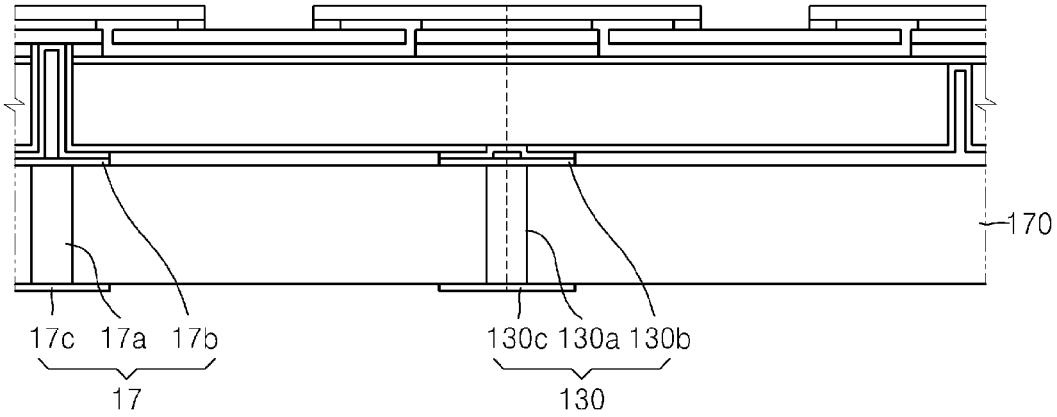

Referring to FIG. 3L, the second substrate 170 including the first and second power supplies 17 and 130 are eutectic bonded to a product produced in the process of FIG. 3J. Since the second substrate 170 including the first and second power supplies 17 and 130 is already described above, a detailed description thereof will be omitted herein. That is, the second substrate 170 is bonded to the product produced in the process of FIG. 3J such that the first and second power supplies 17 and 130 may contact the first and second contacts 16 and 160, respectively.

As such, since the cell 120 is formed by using the two SOI wafers, the cell 120 may be easily manufactured. Also, since there is no patterned portion in the SOI wafer and the first insulation layer 140 during the bonding in the SDB method, the bonding may be performed without alignment so that a manufacturing error may be reduced. In addition, the cavity may be easily formed by the SDB method. Furthermore, since a gap between the vibrator 122 and the first insulation layer 140 is formed using an oxide layer, uniform gap control may be possible.

In the above-described ultrasonic transducer 10, the electrode layer 15 functions as a common electrode, whereas the first substrate 110 functions as an individual electrode. However, the exemplary embodiments are not limited thereto. The electrode layer 15 may function as an individual electrode and the first substrate 110 may function as a common electrode.

Figure 4:
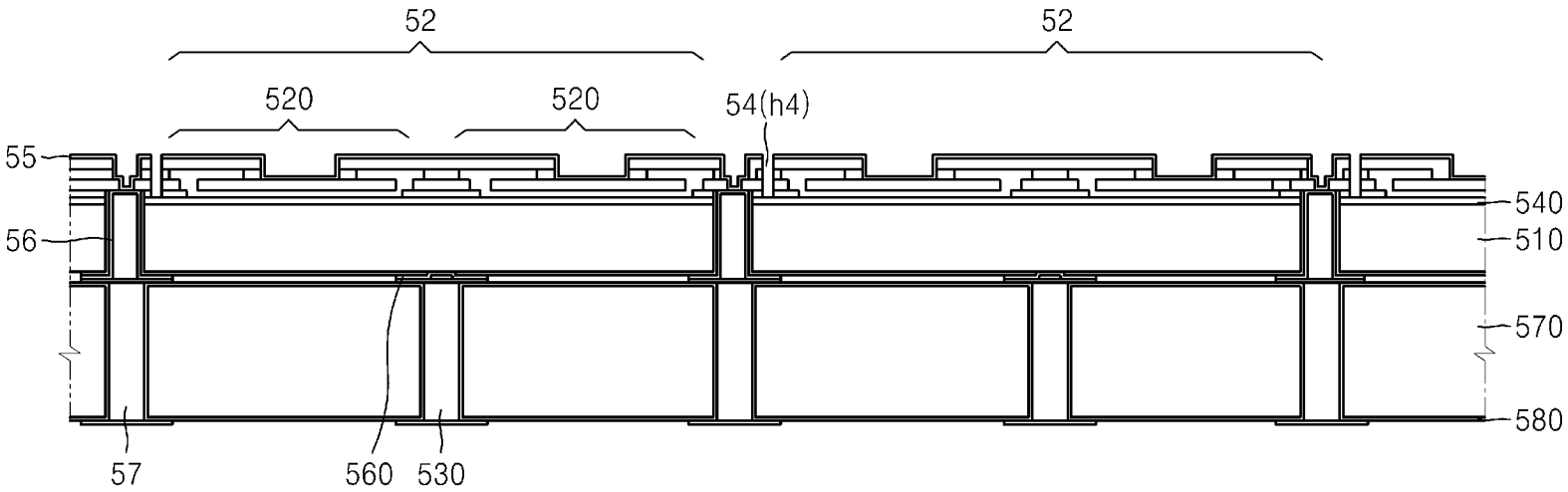
FIG. 4 is a cross-sectional view schematically illustrating an ultrasonic transducer according to another exemplary embodiment.

FIG. 4 is a cross-sectional view schematically illustrating an ultrasonic transducer 50 according to another exemplary embodiment. Referring to FIG. 4, the ultrasonic transducer 50 may include a plurality of elements 52 of the ultrasonic transducer 50 (hereinafter, referred to as the elements 52) and at least one electric connection preventer 54 preventing electric connection between the elements 52.

In the ultrasonic transducer 50, the elements 52 may be provided in an array of m×n where "m" and "n" are natural numbers equal to or greater than 1. Since the structure of the elements 52 of FIG. 4 is the same as that of the elements 12, a detailed description thereof will be omitted herein.

The electric connector 54 is provided between the elements 52 and prevents the electric connection between the elements 52 to individually drive each of the elements 52. The electric connector 54 is formed as a fourth hole h4 that penetrates the electrode layer 55 included in the elements 52 so as not to be electrically connected to the electrode layer 55 of the elements 52. As a result, the electric connector 54 may reduce interference between the elements 52.

The ultrasonic transducer 50 may further include an electrode layer 55 formed in each of the elements 52, a first electrode contact 56 electrically connected to the electrode layer 55, and a first power supply 57 for applying an electric signal, for a voltage, to the electrode layer 55 via the first electrode contact 56. The first electrode contact 56 may be arranged in an inner area of a fifth hole h5 (not shown) formed in the first substrate 510 and an area around the fifth hole h5. At least a part of an upper portion of the first electrode contact 56 is connected to the electrode layer 55. The first power supply 57 is arranged under the first electrode contact 56 and may be connected to at least a part of a lower portion of the first electrode contact 56. The structure of the first power supply 57 is the same as that of the first power supply 17 of FIG. 1B.

Since the electric connector 54 is formed as the fourth hole h4 penetrating the electrode layer 55, there is no need to separately form a hole penetrating the first substrate 510 and functioning as an electrode. When an independent voltage is applied to the electrode layer 55 through the first electrode contact 56 for each of the elements 52, a common voltage may be applied to the first substrate 510.

The above-described method of manufacturing an ultrasonic transducer may be applied to the ultrasonic transducer of FIG. 4. However, there is a difference in that a hole penetrating the electrode layer 55 is formed instead of a hole penetrating the first substrate 510.

As described above, in the cell of an ultrasonic transducer, the element of an ultrasonic transducer including the cell, the ultrasonic transducer including the element according to the one or more of the above exemplary embodiments, the vibrator may be vibrated in a direction perpendicular to the substrate. Thus, in the cell of the ultrasonic transducer, an electrostatic force and a volume change amount are increased so that a transmission output and a receiving sensitivity of the ultrasonic transducer may be improved.

During the formation of a cell in the ultrasonic transducer, since a gap is formed between the oxide layer and the silicon layer, uniform gap control is made easy.

The elements of the ultrasonic transducer are sectioned by forming a hole in the substrate that supports the cell of the ultrasonic transducer so that an effective area of the ultrasonic transducer and a high frequency range output may be increased. Also, structural interference between the elements may be reduced.

Since the ultrasonic transducer is manufactured by bonding the SOI substrates, a manufacturing error may be reduced and a cavity may be easily formed.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

What is claimed is:

1. An element of an ultrasonic transducer, comprising:

a first substrate;

at least one cell of the ultrasonic transducer located above the first substrate; and a second substrate located under the first substrate, in which a first power supply which applies an electric signal to the first substrate is formed, wherein the first power supply is formed within the second substrate, and comprises a first conductive via formed in an inner portion of the second substrate.

2. The element of claim 1, wherein the first substrate is formed of a low-resistance material.

3. The element of claim 1, wherein the cell of the ultrasonic transducer comprises:

a vibrator which vibrates, and is separated from the first substrate;

a supporter which supports the vibrator; and a connector which connects the vibrator and the supporter.

4. The element of claim 1, wherein the first substrate operates as a first electrode of the cell of the ultrasonic transducer and the cell of the ultrasonic transducer comprises a second electrode corresponding to the first electrode.

5. The element of claim 3, wherein the connector comprises:

a first sub-connector which has one end connected to the vibrator;

a second sub-connector which has one end connected to the supporter; and a third sub-connector which is deformable, and which has one end connected to the first sub-connector and another end connected to the second sub-connector.

6. The element of claim 5, wherein the vibrator vibrates in a direction perpendicular to the first substrate due to deformation of the third sub-connector.

7. The element of claim 5, wherein the third sub-connector is formed of a material that is different from a material of the first sub-connector and a material of the second sub-connector.

8. The element of claim 7, wherein the first sub-connector and the second sub-connector are formed of an oxide and the third sub-connector is formed of silicon.

9. The element of claim 5, wherein the supporter comprises:

a first sub-supporter located on a first insulation layer;

a second sub-supporter located on the first sub-connector and parallel to the vibrator; and a third sub-supporter located on the second sub-supporter.

10. The element of claim 9, wherein the second sub-supporter is formed of a same material as the vibrator.

11. The element of claim 1, wherein the first power supply comprises:

a conductive via located in the second substrate;

a first electrode pad located above the conductive via; and a second electrode pad located under the conductive via.

12. The element of claim 1, wherein the vibrator is formed of silicon.

13. The element of claim 1, further comprising a second insulation layer located under the first substrate and which has an opening formed in an area corresponding to the first power supply.

14. The element of claim 13, further comprising a first electrode contact formed in an area comprising the opening formed in the area corresponding to the first power supply, and electrically connected to the first power supply.

15. An ultrasonic transducer comprising a plurality of elements, the ultrasonic transducer comprising:

a first substrate;

at least one cell of the ultrasonic transducer located above the first substrate; and a second substrate located under the first substrate, in which a first power supply which applies an electric signal to the first substrate is formed, wherein the first power supply is formed within the second substrate, and comprises a first conductive via formed in an inner portion of the second substrate.

16. The ultrasonic transducer of claim 15, wherein the first substrate is included in each of neighboring elements of the ultrasonic transducer and the first substrate of each of the neighboring elements are separated from each other.

17. The ultrasonic transducer of claim 15, further comprising a second power supply which applies a common electric signal to the plurality of elements of the ultrasonic transducer.

* * * * *